US008516861B2

(12) United States Patent
Park et al.

(10) Patent No.: US 8,516,861 B2
(45) Date of Patent: Aug. 27, 2013

(54) WASHING MACHINE

(75) Inventors: Yong Suck Park, Changwon-si (KR); Ig Geun Kweun, Changwon-si (KR); Kyu Hwan Lee, Busan (KR)

(73) Assignee: LG Electronics Inc., Seoul (KR)

( * ) Notice: Subject to any disclaimer, the term of this patent is extended or adjusted under 35 U.S.C. 154(b) by 788 days.

(21) Appl. No.: 12/299,242

(22) PCT Filed: May 2, 2006

(86) PCT No.: PCT/KR2006/001634

§ 371 (c)(1),
(2), (4) Date: Oct. 31, 2008

(87) PCT Pub. No.: WO2007/126169

PCT Pub. Date: Nov. 8, 2007

(65) Prior Publication Data

US 2009/0173110 A1 Jul. 9, 2009

(51) Int. Cl.
*D06F 37/26* (2006.01)

(52) U.S. Cl.
USPC ..... 68/23.1; 66/12.06; 66/23 R; 66/23.2; 66/139; 66/212

(58) Field of Classification Search
USPC ..... 68/23 R, 12.06
See application file for complete search history.

(56) References Cited

U.S. PATENT DOCUMENTS

| | | | | |
|---|---|---|---|---|
| 2004/0123633 | A1 | 7/2004 | Jo | 68/23 |
| 2005/0005650 | A1 | 1/2005 | Kim et al. | 68/23.1 |
| 2005/0103062 | A1 | 5/2005 | Wirthwein et al. | 68/19 |

FOREIGN PATENT DOCUMENTS

| | | | |
|---|---|---|---|
| DE | 102 15 254 | | 10/2003 |
| JP | 07-068086 | * | 3/1995 |
| JP | 2005-340965 | A | 12/2005 |
| KR | 10-2002-0056323 | A | 7/2002 |

OTHER PUBLICATIONS

Machine Translation of JP07-068086 by Yoshikawa et al., published Mar. 14, 1995.*

Korean Office Action dated Jun. 25, 2010 issued in Application No. 10-2008-7025776.

Korean Office Action dated Nov. 11, 2010 issued in Application No. 10-2008-7025776.

German Office Action dated Apr. 4, 2012.

International PCT Search Report dated Jan. 30, 2007.

* cited by examiner

*Primary Examiner* — Michael Kornakov

*Assistant Examiner* — Ryan Coleman

(74) *Attorney, Agent, or Firm* — KED & Associates, LLP

(57) ABSTRACT

Disclosed herein is a washing machine having the structure to reinforce fastening bosses (100) formed on a front surface of a tub (56) to mount a balance weight (90). The washing machine comprises a tub (56) having a gasket coupling part (80) to which a gasket (50) is coupled, a plurality of fastening bosses (100) formed on a circumference about a central axis of the tub (56) to secure a balance weight (90), and a plurality of ribs (310) to reinforce the fastening bosses (100), wherein at least one of the ribs (310) formed in an outer direction of the tub (56) around each fastening boss (100) is thicker than the ribs (310) formed towards the central axis of the tub (56).

32 Claims, 4 Drawing Sheets

WASHING MACHINE

TECHNICAL FIELD

The present invention relates to a washing machine, and more particularly, to a washing machine, which has structure to reinforce fastening bosses formed on a front surface of a tub to mount a balance weight.

BACKGROUND ART

Generally, washing machines are classified into pulsator type washing machines which wash laundry using water motion generated by rotating a plate-shaped pulsator, and drum type washing machines which wash the laundry using falling of water and the laundry and frictional force therebetween generated within a horizontally laid tub by rotating the tub.

Among these washing machines, the drum type washing machine has been increasingly demanded in recent years due to its merits over the pulsator type washing machine in that the drum type washing machine uses a smaller amount of water and detergent, and is substantially free from damage and entanglement of the laundry when washing the laundry.

Generally, the construction of the drum type washing machine can be divided into a tub supported by dampers and springs within a cabinet, a cylindrical drum rotatably mounted in the tub, and a driving unit connected with the drum via a shaft to rotate the drum.

The cabinet is provided at a front side thereof with a door corresponding to an opening of the drum, a gasket between the door and the drum to maintain sealing of the drum, and a controller positioned above the door to control operation of the washing machine according to commands input by a user.

Meanwhile, a balance weight is mounted to either side of the front surface of the tub by means of a plurality of fastening ribs formed on the tub, and prevents vibration of the driving unit caused by unbalance of laundry contained within the drum using center of gravity of the balance weight.

For the drum type washing machine constructed as described above, rotational force of a rotor is transmitted to the drum via the shaft, and rotates the drum so that the laundry is lifted by baffles, and then dropped by gravity, thereby performing washing operation.

However, there is a problem in that the fastening bosses serving to mount the balance weights to the tub are damaged due to concentration of vibration from the tub and loads from the balance weights on the respective bosses when the drum rotates at high speeds.

DISCLOSURE OF INVENTION

Technical Problem

An object of the present invention devised to solve the problem lies on a washing machine adapted to reinforce respective fastening bosses formed on a tub for mounting balance weights to the tub in order to prevent damage of the respective fastening bosses.

Technical Solution

The objects of the present invention can be achieved by providing a washing machine, comprising: a tub having a gasket coupling part to which a gasket is coupled; a plurality of fastening bosses formed on a circumference about a central axis of the tub to secure a balance weight; and a plurality of ribs to reinforce the fastening bosses, wherein at least one of the ribs formed in an outer direction of the tub around each fastening boss is thicker than the ribs formed towards a central axis of the tub.

Preferably, the number of ribs formed in the outer direction of the tub is more than those formed towards the central axis of the tub.

Preferably, a connecting portion between the tub and each fastening boss is rounded.

The washing machine may further comprise protrusions formed on a surface of the tub where the respective fastening bosses and the respective ribs are formed.

The washing machine may further comprise at least one circumferential rib protruded circumferentially on the tub.

The circumferential rib may be a first circumferential rib connecting the fastening bosses with each other.

The circumferential rib may be a second circumferential rib between an outer periphery of the tub and the respective fastening bosses.

The circumferential rib may be a third circumferential rib between the gasket coupling part and the respective fastening bosses.

The third circumferential rib may have a height lower than that of a mold line for the gasket coupling part.

In accordance with another aspect of the present invention, a tub for a washing machine is provided, the washing machine comprising a tub having a gasket coupling part to which a gasket is coupled, a plurality of fastening bosses formed on a circumference about a central axis of the tub to secure a balance weight, and a plurality of ribs to reinforce the fastening bosses, wherein at least one of the ribs formed in an outer direction of the tub around each fastening boss is thicker than the ribs formed towards the central axis of the tub.

Advantageous Effects

With this construction, the present invention has advantageous effects as follows.

Firstly, according to the present invention, among the plural ribs to reinforce the fastening bosses, the rib formed at a portion on which stresses are concentrated is formed thicker than the other ribs, thereby preventing the fastening bosses from be damaged due to stress concentration.

Secondly, according to the present invention, the connecting portion between the tub and the fastening bosses is rounded to increase an area thereof so that the stress applied to the connecting portion can be dispersed, thereby preventing the connecting portion from being damaged.

Thirdly, according to the present invention, the ribs are formed along the circumference of the tub while being connected with the respective fastening bosses, thereby multiplying the strength of the tub and the fastening bosses.

Finally, since the present invention prevents the respective fastening bosses from being damaged due to stress concentration upon rotation of the drum at high speeds, reliability for the products can be enhanced.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
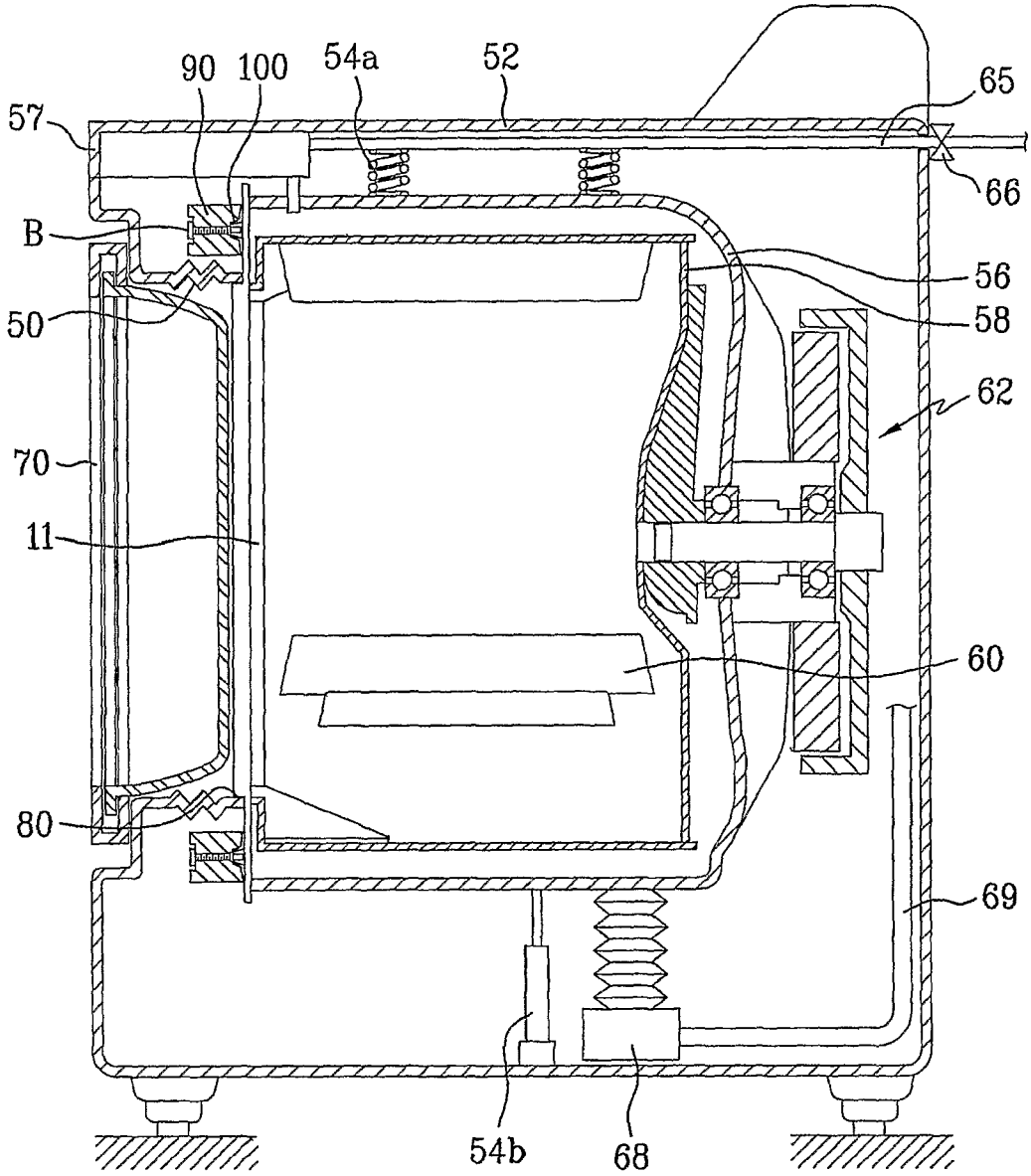
FIG. 1 is a longitudinal sectional view illustrating the inner construction of a drum type washing machine in accordance with the present invention.

First, FIG. 1 is a longitudinal sectional view illustrating the inner construction of a drum type washing machine in accordance with the present invention.

Figure 2:
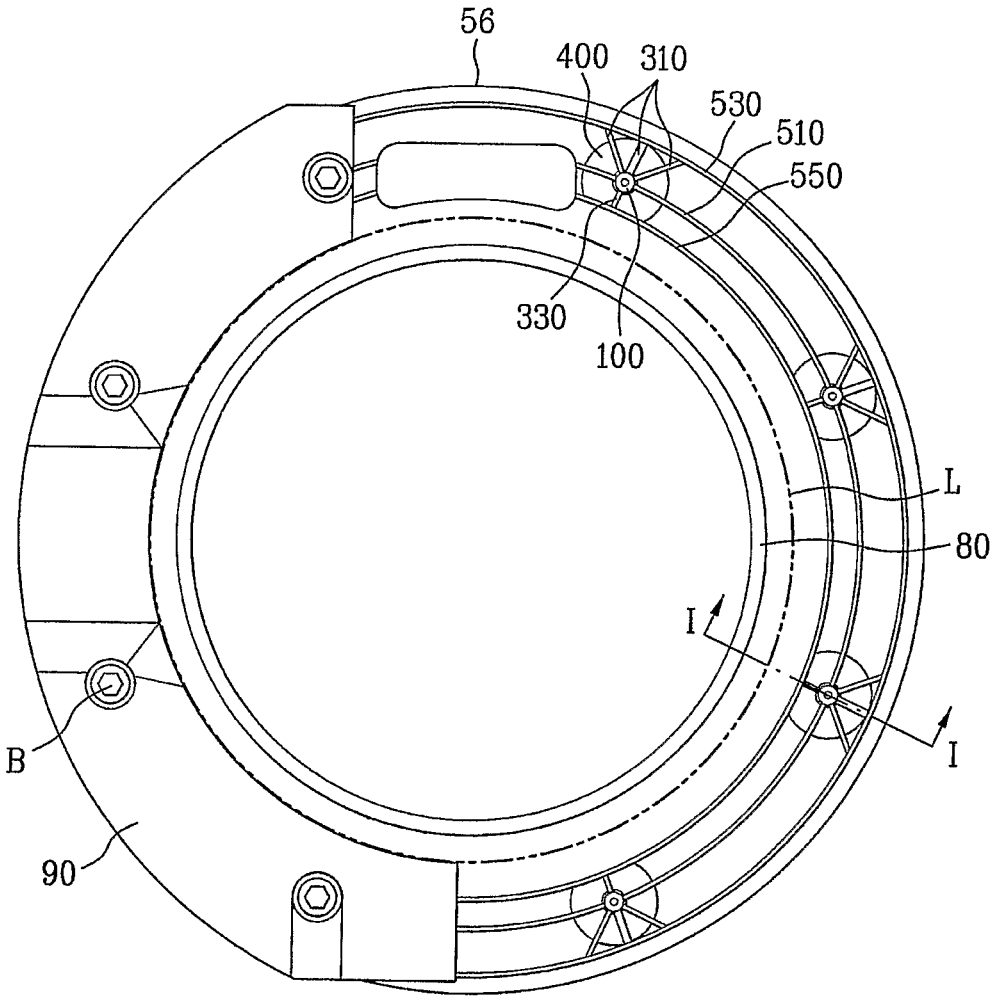
FIG. 2 is a front view illustrating the construction of a tub having respective fastening bosses in accordance with the present invention.

FIG. 2 is a front view illustrating the construction of a tub having respective fastening bosses in accordance with the present invention. Here, In FIG. 2, one of left and right balance weights is shown in order to illustrate the shape of a tub and fastening bosses.

Figure 3:
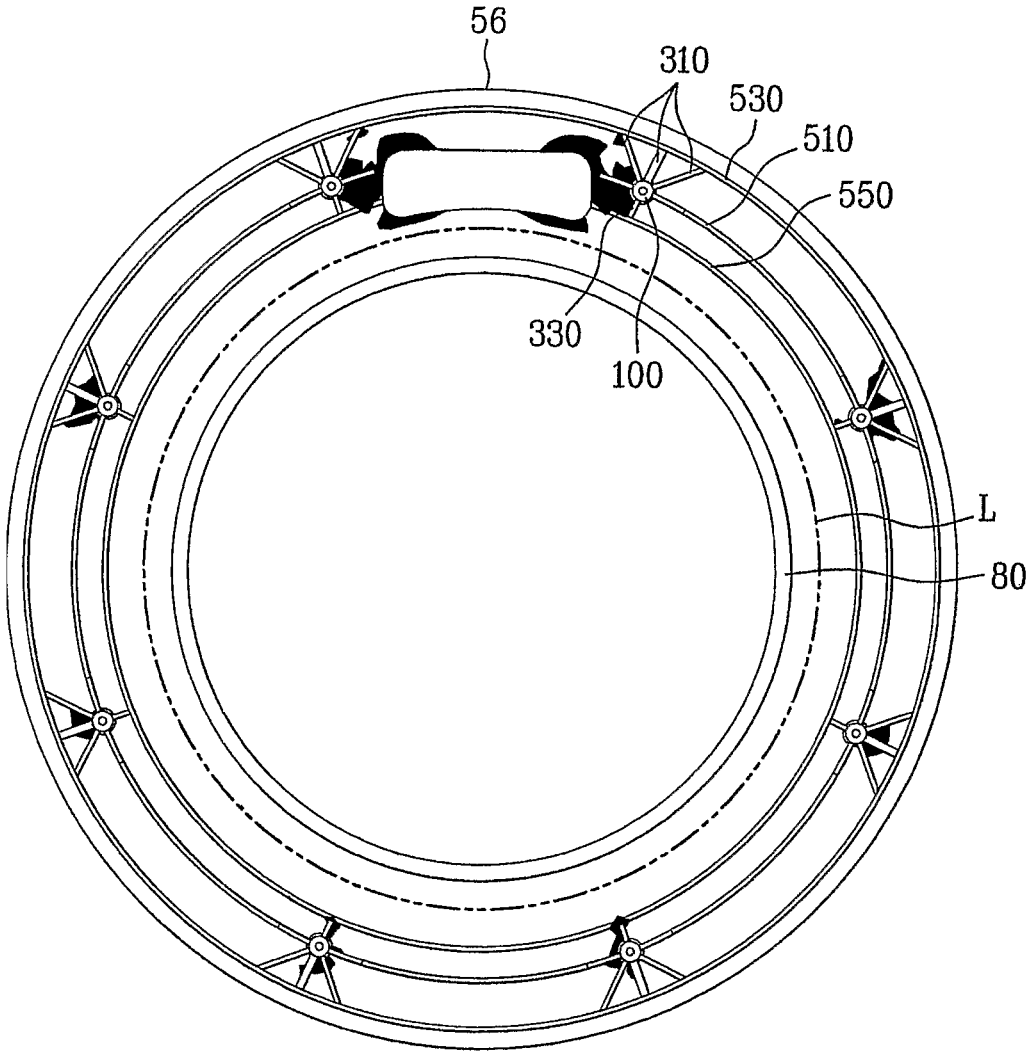
FIG. 3 is a schematic view illustrating stress distribution on each rib for each fastening boss in accordance with the present invention.
Figure 4:
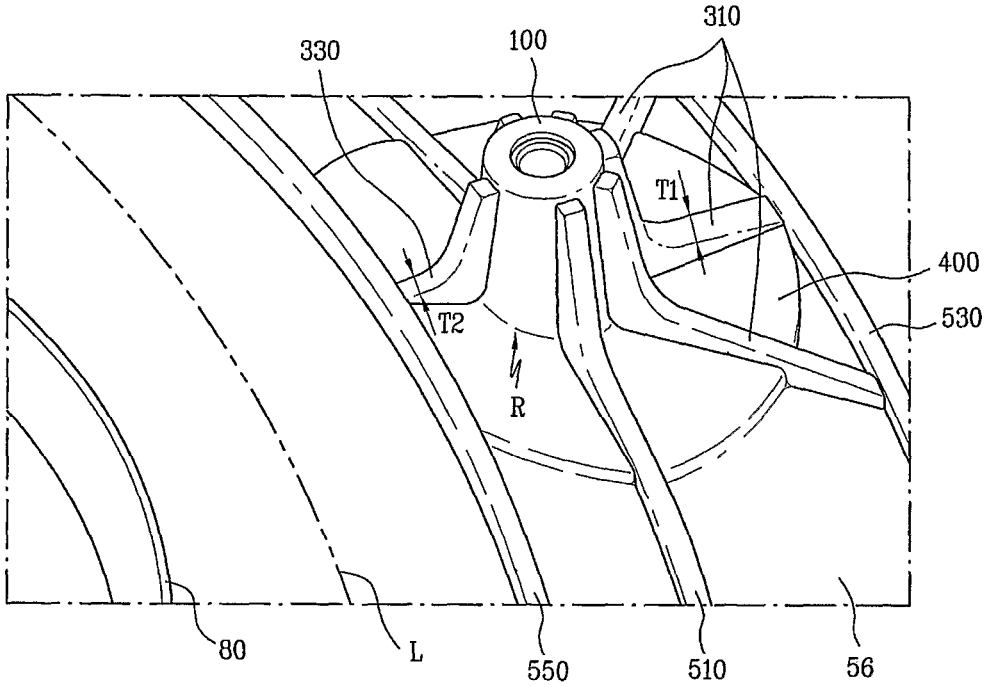
FIG. 4 is a perspective view illustrating a main part of a fastening boss having an enhanced strength in accordance with the present invention.
Figure 5:
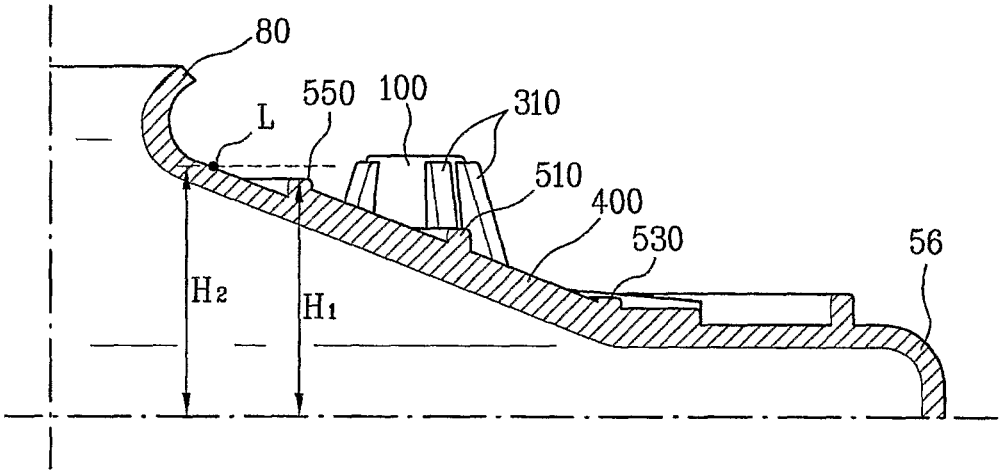
FIG. 5 is a cross sectional view taken along line I-I of FIG. 2.

FIG. 3 is a schematic view illustrating stress distribution on each rib for each fastening boss in accordance with the present invention, FIG. 4 is a perspective view illustrating a main part of a fastening boss having an enhanced strength in accordance with the present invention, and FIG. 5 is a cross sectional view taken along line I-I of FIG. 2.

As shown in FIGS. 1 and 2, the drum type washing machine according to the present invention comprises a tub 56 supported in a cabinet 52 opened at the front side thereof by means of a spring 54*a* and a damper 54*b*, a drum 58 rotatably installed within the tub 56, lifters 60 formed on an inner surface of the drum 58 and serving to lift laundry to a predetermined height, a cabinet cover 53 attached to the front side of the cabinet 52 and having an input port 11 through which the laundry is input into or taken from the drum 58, and a door 70 attached to the input port 11 of the cover 53 at the front side of the cabinet to prevent the laundry from falling out from the drum 58.

The washing machine further comprises a control panel 57 on the cabinet 52, a water supply hose 65 and a water supply valve 66 installed at one side of an upper portion inside the cabinet 52 to supply water into the tub 56, and a water drainage hose 68 and a water drainage valve 66 installed at one side of a lower portion inside the cabinet 52 to drain the water from the washing machine.

A gasket coupling part 80 is formed at the front side of the tub 56, and a heater (not shown) is mounted to a lower side of the tub 56 to control temperature of water supplied into the tub 56 and the drum 58. In addition, a motor 62 is secured to a rear side of the tub 56, and connected with the drum 58 to rotate the drum 58.

Here, the gasket coupling part 80 is mounted with a gasket 50 to seal between the door 70 and the input port 11.

Meanwhile, a balance weight 90 is mounted to either side on the front surface of the tub 56, and prevents vibration of the driving unit caused by unbalance of the laundry contained within the drum.

The tub 56 has a plurality of fastening bosses 100 formed along a circumference about a central axis of the tub 56 to mount the balance weights 90 to the tub such that the balance weights 90 are fastened to the fastening bosses 100 by means of bolts B.

According to the embodiment, a plurality of ribs is formed to reinforce the fastening bosses 100. Among the ribs around each of the fastening bosses 100, at least one of the ribs (which will be referred to as first ribs 310) formed in an outer direction of the tub 56 are preferably thicker than the ribs (which will be referred to as second ribs 330) formed towards the central axis of the tub 56.

Preferably, the number of first ribs 310 is more than the number of second ribs 330.

With a result of analyzing stress applied to each rib through the balance weight 90 when the drum 58 is rotated at a high speed of, for example, 1,600 rpm, it can be appreciated that the first ribs 310 are subjected to a higher stress than the second ribs 330, as shown in FIG. 3.

Accordingly, since the first ribs 310 are likely to be broken in comparison to the second ribs 330, it is desirable that the thickness of first ribs 310 be higher than that of the second ribs 330, and the number of first ribs 310 be more than the number of second ribs 330.

At this time, in this embodiment, as shown in FIG. 4, among the first ribs formed in the outer direction of the tub 56 around each of the fastening bosses 100, the first rib 310 opposite to any one of the second ribs 330 has a thickness T1 higher than a thickness T2 of the respective ribs 330.

Preferably, each of connecting portions between the tub 56 and the respective fastening bosses 100 is rounded.

In other words, when forming the connecting portion between the tub 56 and the respective fastening bosses 100 into a round shape, an area of the connecting portion between the tub 56 and the fastening bosses 100 is increased, and vibration of the tub 56 and the stress transmitted through the balance weights 90 are dispersed, thereby preventing damage of the connecting portion between the tub 56 and the fastening bosses 100.

Meanwhile, according to the embodiment, the tub may further comprise protrusions 400 at portions where the respective fastening bosses 100 and the respective ribs 310 and 330 are formed.

With the protrusions 400, it is possible to further reinforce the respective fastening bosses 100 and the respective ribs 310 and 330.

According to this embodiment, the tub 56 has at least one circumferential rib circumferentially protruded thereon in order to multiply the strength of the tub 56 and the fastening bosses 100. In this embodiment, three circumferential ribs are formed.

The circumferential ribs may comprise a first circumferential rib 510 formed to connect the fastening bosses 100 with each other, a second circumferential rib 530 formed between an outer periphery of the tub 56 and the respective fastening bosses 100, and a third circumferential rib 550 between the gasket coupling part 80 and the respective fastening bosses 100.

Here, the first circumferential rib 510 may be formed to connect the respective fastening bosses 100 with each other while extending to outer peripheral surfaces of the respective fastening bosses 100.

The second circumferential rib 530 is preferably formed between the outer periphery of the tub 56 and the respective fastening bosses 100 such that distal ends of the respective first ribs 310 formed in the outer direction of the tub 56 are connected with the second circumferential rib 530.

The structure wherein the second circumferential rib 530 is formed to connect with the first ribs 310 is provided for the purpose of allowing the stress applied to the respective fastening bosses 100 to be dispersed to the second circumferential rib 530 through the first ribs 310.

In addition, the third circumferential rib 550 is preferably formed between the gasket coupling part 80 and the respective fastening bosses 100 such that distal ends of the respective second ribs 330 formed towards the center of the tub 56 are connected with each other via the third circumferential rib 550.

The structure wherein the second ribs 330 are connected with the third circumferential rib 550 is provided for the purpose of allowing the stress applied to the respective fastening bosses 100 to be dispersed to the third circumferential rib 550 via the second ribs 330.

Meanwhile, the height of the third circumferential rib 550 is preferably lower than a mold line L of the gasket coupling part 80.

More specifically, when the tub 56 is produced using two molds (not shown), one of which is referred to as a first mold to form the gasket coupling part 80 and the other of which is referred to as a second mold to form remaining parts of the tub 56, the mold line L is formed on the tub 56 along a separation part between the first and second molds.

That is, it is preferable that the height of the third circumferential rib 550 is lower than the mold line L in order to prevent a portion of the second mold to form the third circumferential rib 550 from interfering with the first mold when separating the first mold during a process of separating the molds.

Operation of the embodiment according to the present invention described above will be described as follows.

With fastening bosses 100 formed on a front surface of the tub 56 to mount balance weights 90 to the tub, plural ribs are placed near an associated fastening boss 100 such that the rib formed corresponding to a portion likely to suffer from concentration of stress is formed thicker than other ribs. In addition, protrusions are formed on respective portions where the fastening bosses 100 and the respective ribs are formed, and circumferential ribs are formed on the tub 56 in order to further reinforce the fastening bosses 100. With this structure, even if vibration caused by rotation of the drum at high speeds and stress caused by the load of the balance weights 90 are concentrated on the respective fastening bosses 100, the fastening bosses 100 can endure the vibration and the stress, and thus, can be prevented from breaking.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention has industrial applicability in that, since the tub and the fastening bosses formed on the front side of the tub are reinforced, even if vibration caused by rotation of the drum at high speeds and stress caused by the load of the balance weights are concentrated on the respective fastening bosses, the fastening bosses can endure vibration and stress, and can be prevented from breaking, thereby increasing satisfaction of consumers with respect to the corresponding products.

What is claimed is:

1. A washing machine, comprising:

a tub;

a gasket coupling part to which a gasket is coupled;

a plurality of fastening bosses disposed along a circumference of and arranged about a central axis of the tub;

a plurality of weights coupled to respective ones of the fastening bosses;

a plurality of ribs to reinforce each of the fastening bosses, wherein:

each boss includes ribs arranged in a radial configuration with respect to a center of each boss, at least some of the ribs in the radial configuration having a first portion coupled directly to an outer radial wall of the boss and a second portion extending outwardly away from a boss, the first portion extending along the outer radial wall substantially to a top of the outer radial wall, the ribs in the radial configuration including at least two first ribs extending outwardly away from the central axis of the tub and at least one second rib extending inwardly towards the central axis of the tub, wherein at least some of the first and second ribs have a substantially L-shape configuration, the first portion extending in a vertical direction and provided at a circumference of the boss, and the second portion extending in a horizontal direction extending outwardly away from the first portion, and at least one of the at least two first ribs is thicker than the at least one second rib.

2. The washing machine according to claim 1, wherein a number of the first ribs extending away from the central axis the tub is more than a number of second ribs extending towards the central axis of the tub.

3. The washing machine according to claim 1, wherein a connecting portion between the tub and each fastening boss is substantially rounded.

4. The washing machine according to claim 1, further comprising: protrusions formed on a surface of the tub where fastening bosses are located.

5. The washing machine according to claim 1, further comprising a circumferential rib between an outer periphery of the tub and the fastening bosses.

6. The washing machine according to claim 1, further comprising a circumferential rib between the gasket coupling part and the fastening bosses.

7. The washing machine according to claim 6, wherein the circumferential rib between the gasket coupling part and fastening bosses is below a mold line for the gasket coupling part.

8. A tub for a washing machine, comprising:

a gasket coupling part to which a gasket is coupled;

a plurality of fastening bosses disposed along a circumference of and arranged about a central axis of the tub, the fastening bosses adapted to be coupled to a plurality of weights; and a plurality of ribs to reinforce each of the fastening bosses, wherein:

each boss includes ribs arranged in a radial configuration with respect to a center of each boss, at least some of the ribs in the radial configuration having a first portion coupled directly to an outer radial wall of the boss and a second portion extending outwardly away from the boss, the first portion extending along the outer radial wall substantially to a top of the outer radial wall, the ribs in the radial configuration including at least two first ribs extending outwardly away from the central axis of the tub and at least one second rib extending inwardly towards the central axis of the tub, wherein at least some of the first and second ribs have a substantially L-shape configuration, the first portion extending in a vertical direction and provided at a circumference of the boss, and the second portion extending in a horizontal direction extending outwardly away from the first portion, and at least one of the at least two first ribs is thicker than the at least one second rib.

9. The tub according to claim 8, wherein a number of the first ribs extending away from the central axis the tub is more than a number of second ribs extending towards the central axis of the tub.

10. The tub according to claim 8, wherein a connecting portion between the tub and each fastening boss is substantially rounded.

11. The tub according to claim 8, further comprising:

protrusions formed on a surface of the tub where fastening bosses are located.

12. The tub according to claim 8, wherein at least one circumferential rib is between an outer periphery of the tub and the fastening bosses.

13. The tub according to claim 8, wherein at least one circumferential rib is between the gasket coupling part and the fastening bosses.

14. The tub according to claim 13, wherein the circumferential rib between the gasket coupling part and fastening bosses is below a mold line for the gasket coupling part.

15. The washing machine according to claim 5, wherein a distal end of the at least one of the two first ribs extending away from the central axis of the tub is coupled to the circumferential rib between an outer periphery of the tub and the fastening bosses.

16. The washing machine according to claim 6, wherein a distal end of the at least one second rib extending towards the central axis of the tub is coupled to the circumferential rib between the gasket coupling part and the fastening bosses.

17. The tub according to claim 8, wherein a distal end of the at least one of the two first ribs extending away from the central axis of the tub is coupled to a circumferential rib between an outer periphery of the tub and the fastening bosses.

18. The tub according to claim 8, wherein a distal end of the at least one second rib extending towards the central axis of the tub is coupled to a circumferential rib between the gasket coupling part and the fastening bosses.

19. The washing machine according to claim 1, further comprising:

a first circumferential rib coupled to at least two of the fastening bosses, a second circumferential rib between an outer periphery of the tub and the fastening bosses, and a third circumferential rib between the gasket coupling part and the fastening bosses.

20. The washing machine of according to claim 19, wherein the second and third circumferential ribs are disposed at different heights.

21. The washing machine of claim 20, wherein the first, second, and third circumferential ribs are disposed at different heights.

22. The washing machine according to claim 1, wherein each of the at least two first ribs is longer than the at least one second rib.

23. The washing machine according to claim 1, wherein one of the at least two first ribs and at least one second rib are arranged substantially along a common axis.

24. The washing machine according to claim 23, where the common axis passes through the central axis of the tub.

25. The washing machine according to claim 1, further comprising:

at least one reinforcing section disposed between one of the at least two first ribs and the at least one second rib, the at least one reinforcing section coupled to and extending above a surface of the tub.

26. The washing machine according to claim 25, wherein the at least one reinforcing section is in contact with one of the first ribs or the second rib.

27. The washing machine according to claim 1, wherein at least one of the fastening bosses is coupled to a slanted surface relative to the tub.

28. The washing machine according to claim 5, wherein at least one first rib is coupled to the at least one circumferential rib located between the outer periphery of the tub and the fastening bosses, to disperse stress applied to one or more of the fastening bosses.

29. The washing machine according to claim 6, wherein at least one second rib is coupled to the circumferential rib located between the gasket coupling part and the fastening bosses, to disperse stress applied to one or more of the fastening bosses.

30. The tub according to claim 12, wherein the at least one first rib is coupled to the at least one circumferential rib located between the outer periphery of the tub and the fastening bosses, to disperse stress applied to one or more of the fastening bosses.

31. The tub according to claim 13, wherein the at least one second rib is coupled to the circumferential rib located between the gasket coupling part and the fastening bosses, to disperse stress applied to one or more of the fastening bosses.

32. The tub according to claim 8, wherein a connection portion between the first and second portions is substantially rounded.

* * * * *